United States Patent [19]

Fleissner

[11] Patent Number: 4,811,574

[45] Date of Patent: Mar. 14, 1989

[54] APPARATUS FOR FLOW-THROUGH TREATMENT OF TEXTILE MATERIAL, PAPER, OR THE LIKE

[75] Inventor: Gerold Fleissner, Chur, Switzerland

[73] Assignee: Fleissner Maschinenfabrik AG, Rebstein, Switzerland

[21] Appl. No.: 204,289

[22] Filed: Jun. 9, 1988

[30] Foreign Application Priority Data

Jan. 30, 1988 [DE] Fed. Rep. of Germany ..... 3802791

[51] Int. Cl.[4] ..... D06B 3/02

[52] U.S. Cl. ..... 68/5 D; 68/158; 68/DIG. 5; 34/123

[58] Field of Search ..... 68/DIG. 5, 5 D, 158, 68/184; 34/111, 122, 123, 139

[56] References Cited

U.S. PATENT DOCUMENTS

| | | | |
|---|---|---|---|
| 3,276,140 | 10/1966 | Walser et al. | 34/122 X |
| 3,303,576 | 2/1967 | Sisson | 34/122 X |
| 3,752,639 | 8/1973 | Thagarg, Jr. | 34/122 X |
| 3,955,226 | 5/1976 | Feess et al. | 68/DIG. 5 X |

FOREIGN PATENT DOCUMENTS 1460525 11/1970 Fed. Rep. of Germany ... 68/DIG. 5

*Primary Examiner*—Harvey C. Hornsby
*Assistant Examiner*—Frankie L. Stinson
*Attorney, Agent, or Firm*—Antonelli, Terry & Wands

[57] ABSTRACT

A permeable drum for the wet or dry treatment of textile material, paper, or other permeable materials of a certain width has a screen-like cover supported solely on narrow sheet metal strips or narrow webs. The sheet metal strips extend axially parallel, their extension in width being oriented in the radial direction. The webs are oriented in the peripheral direction and form part of the connecting elements between the sheet metal strips, these connecting elements also carrying the screen-type cover. The connecting elements, also serving as spacers, are formed of one piece and connect two neighboring sheet metal strips. Connection of the spacers with the sheet metal strips is achieved by screws, bolts or the like, of which suitably two in superposition extend longitudinally through bores in the connecting elements. While the web of the connecting element is fashioned to be narrow, the base should be broader in order to provide a good seal for the peripheral region of the drum that is not under a suction draft.

12 Claims, 2 Drawing Sheets

APPARATUS FOR FLOW-THROUGH TREATMENT OF TEXTILE MATERIAL, PAPER, OR THE LIKE

This invention relates to an apparatus for the flow-through treatment of textile material, nonwovens, or paper, with a gaseous or liquid treatment medium circulated in the entire apparatus and including a permeable drum that is subjected to throughflow of the medium from the outside toward the inside, and that is under a suction draft, the drum having end plates at end faces and serving as a conveying element. This drum is covered on its periphery with a screen-type cover. Sheet metal strips extending in the axial direction of the drum are arranged between the end plates of the drum, the width of each of these sheet metal strips extending substantially in the radial direction, and connecting elements for connecting the sheet metal strips are arranged in the peripheral or transverse direction between the sheet metal strips.

An apparatus of a similar type has been known from German Pat. No. 1,946,376. The connecting elements consist of U-shaped spacers associated with each sheet metal strip and welded to the sheet metal strip on a rear side. The two arms of the respective spacers overlap in the zone of the center between two juxtaposed sheet metal strips and are welded together at that location in accordance with the desired spacing and, respectively, according to the respective diameter of the drum. A drum of this type can be manufactured in a considerably simpler way than the constructions of, for example, German Pat. No. 1,294,178 or U.S. No. Pat. No. 3,590,453, the drum bodies of which are formed from metal strips extending in a zigzag form in the axial direction and being joined by welding, in such a way that the screen-like cover has a honeycomb-shaped structure. In contrast thereto, individual spacers can be manufactured more easily; also, the desired drum jacket can be readily mounted. However, there is still the drawback that it is necessary to weld the spacers to one another and to the metal strips, causing stresses in the material which are of great disadvantage for the required true-running accuracy of the drum.

This invention is based on the object of providing a drum structure abandoning the conventional honeycomb structure and rather utilizing readily mountable spacers comprising connecting elements between the sheet metal strips, which connecting elements, however, are to be fashioned additionally so that a welding joint can be avoided and yet optimum permeability up to 90% is afforded for the fluid medium flowing through the periphery of the drum.

In order to attain this object, the invention provides a further development of the apparatus according to German Pat. No. 1,946,376, wherein (a) the connecting elements are in each case fashioned of one piece, i.e., the elements are cast or molded of metal as a unitary piece, (b) the connecting elements are each designed of a width corresponding to the desired spacing of the directly adjacent sheet metal strips, and (c) the connecting elements are each firmly connected on both sides with adjoining sheet metal strips.

This firm connection can be effected by means of externally threaded pegs attached to the connecting elements, or suitably by means of screws or rivets passed transversely through the connecting elements and pushed at least through two of the neighboring sheet metal strips and being wedged together with the strips from the outside.

The spacers or connecting elements according to this invention exhibit a special cross-section of a particular structure for reasons of strength of the entire drum construction and also for reasons of satisfactory air permeability of the drum and, finally, for providing adequate sealing from the inside of the drum. This structure will be hereinafter described in greater detail in the following description of the FIGURES.

The accompanying drawings illustrate embodiments of the apparatus according to the invention, wherein.

Figure 1:
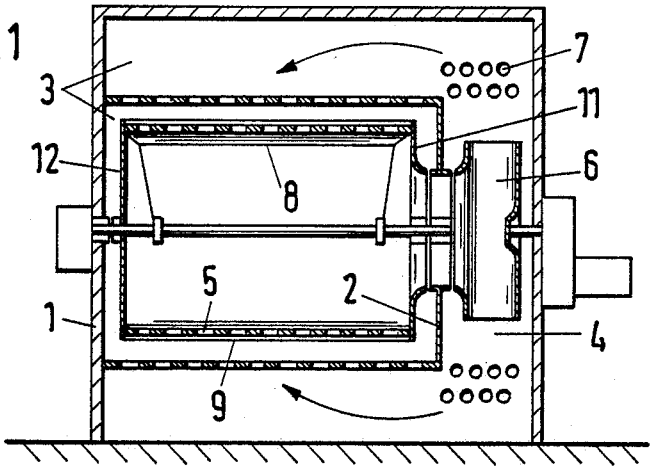
FIG. 1 shows a section taken longitudinally through a sieve drum dryer, the drum jacket of which is, however, not perforated as in a customary sieve drum drier but rather the jacket comprises a sheet metal strip structure.

The drum device according to FIG. 1 consists of a rectangular housing 1 subdivided by a partition 2 into a treatment chamber 3 and a fan chamber 4. In the treatment chamber 3, a drum 5 is rotatably supported and, concentrically thereto, a fan 6 is rotatably mounted in the fan chamber 4. The fan chamber can, of course, also be arranged in a segregated, separate fan housing, not shown herein. In each case, the fan places the interior of the drum 5 under a suction draft. The present invention likewise includes a drum construction in connection with a wet treatment device which can also serve merely for suction removal of liquid. The total structure must then be adapted correspondingly.

According to FIG. 1, heating units 7 are respectively located above and below the fan 6; these heating units consist of pipes traversed by a heating medium. In general, the drum of interest has a structure, which is up to 90% air-permeable, and is built with a very large diameter. Also, the drum is covered during the heat treatment with the textile material or paper over almost the entire peripheral surface area. In the zone of the feeding and removing of the textile material or paper, the drum is to be shielded, however, from the inside against the inwardly prevailing suction draft; for this reason, FIG. 1 shows the inner protective cover 8. However, in this embodiment, the inner protective cover could also be fixedly mounted at the level of the drum axis. On the outside, a fine-mesh screen 9 is wrapped around the drum structure and is attached at the end faces of the drum to the two end plates 11, 12.

Figure 2:
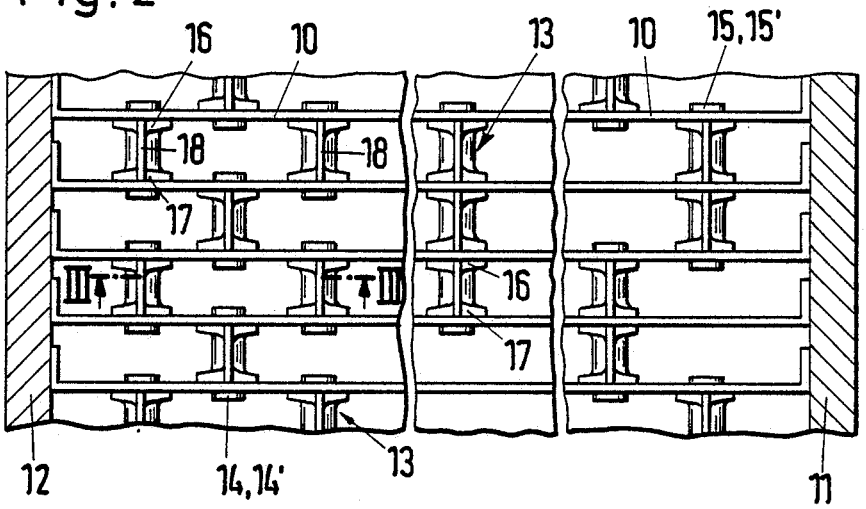
FIG. 2 shows in an enlarged top view the sheet metal structure of the drum jacket.

The drum structure can be seen in a top view in FIG. 2. The structure consists of axially aligned sheet metal strips 10; the width of each strip can be seen from FIG. 3 and extends essentially in the radial direction. Therefore, the screen-type cover 9 rests initially only on the edges of the sheet metal strips 10 that are located radially on the outside periphery of the drum. The sheet metal strips 10 are attached at a defined distance side-by-side to the two end plates 11, 12 by means of screws, bolts or rivets (not shown). In order to maintain this distance over the width of the drum 5 when the material to be treated, e.g. textile material, paper, or the like, is applied, connecting elements are provided, denoted in their entirety by reference numeral 13 and serving as spacer means; these connecting elements are joined to the sheet metal strips 10 by means of screws or threaded bolts 14, 15.

The connecting elements 13 can be arranged in mutually staggered fashion, as illustrated in the left-hand portion of FIG. 2. This construction has the drawback that a relatively large number of screws or bolts 14, but shorter ones, with associated nuts are included in the total structure of the drum, and/or must be mounted. In the right-hand portion of FIG. 2, in contrast thereto, a construction is illustrated wherein respectively two of the connecting elements are arranged aligned in series and are connected by only one screw or bolt 15 (at the upper portion of the units) with the sheet metal strips 10, this screw or bolt passing through both of these connecting elements. These connecting elements, here again arranged in a staggered pattern, then have a larger free spacing from one another so that the result also is a higher air permeability over the total surface area of the drum. In this case, respectively one bolt less is employed, but this becomes noticeable only in conjunction with the head and the necessary nut for the bolt. Of course, it is also possible to mount three or even more of the connecting elements, as illustrated in the central portion of FIG. 2, in succession, but one must keep in mind here that the resultant structure affects the strength of the drum.

The connecting elements 13 have approximately the shape of a double T, according to FIG. 2. This cross-section results from the necessary, firm contact of the connecting elements 13 against the sheet metal strips 10. The double T cross-section provides a more rugged total structure of the drum and presents greater rigidity against twisting. The connecting elements, however, are not fashioned with the flanges 16, 17 over their entire height, but only in the zone of the screws or bolts 14 penetrating the connecting elements, as can be seen from FIG. 3. The radially outwardly located region of each connecting element consists only of the narrow web 18, on which then additionally the screen-type cover 9 is resting as well as on the sheet metal strips 10. Thereby, an extremely small total contact surface results, namely 10% of the entire peripheral area of the drum. Consequently, the drum jacket surface is 90% air-permeable. Even though the cross-section of the connecting elements increases radially inwardly, this only results in an increase in air flow in the space between the various elements making up the drum structure. This, however, has substantially no influence on the air permeability of the periphery of the drum and has no significance for the throughflow effect, i.e. for the treatment of the respectively applied material.

Figure 3:
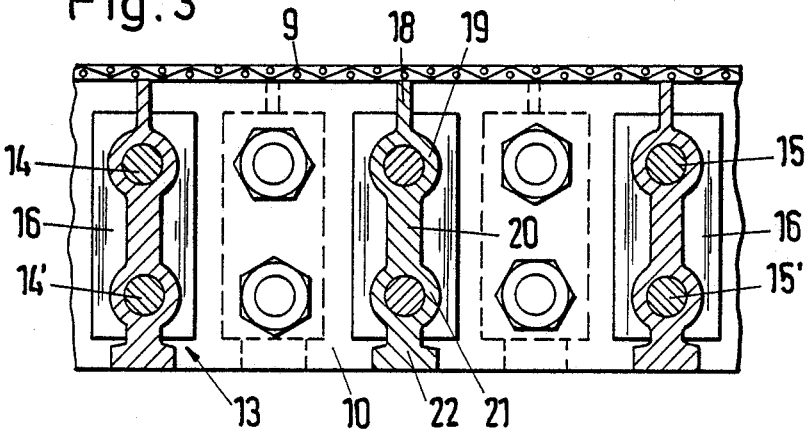
FIG. 3 shows an enlarged representation of a sectional view taken along line III—III of FIG. 2.

FIG. 3 shows the radial cross-section of the connecting elements 13. The cross-section of the double T shape according to FIG. 2 can be further seen from FIG. 3 by the rectangular flange 16. This flange neither extends to the radially outward edge nor up to the radially inward edge of the sheet metal strip 10. The connecting element 13 is, in total, fashioned to be very thin, namely only solid enough to attain the required strength and to provide adequate support for the screws 14, 14'; 15, 15' penetrating the connecting element 13. The thickness of the material in the zone of the screen-type cover 9 is very thin due to the web 18. A tubular section 19 follows thereafter, for accommodating the first screw 14, 15. Further radially inwardly, a wall or internal web 20 is provided up to the subsequent screw 14', 15'; this wall is designed to be narrower in cross-section for weight considerations. There then follows the tubular section 21 for the screw 14', 15', and adjoining thereto is the base 22 of the connecting element 13 extending up to the radially inwardly located edge of the sheet metal strip 10. This base 22, in turn, is designed to be somewhat broader to provide adequate sealing of the air-permeable and air-impermeable parts with the aid of the inner protective cover 8.

Figure 4:
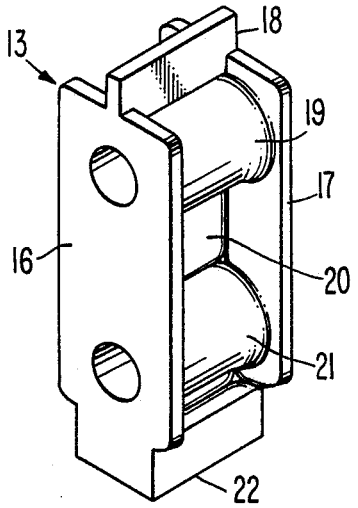
FIG. 4 shows a perspective view of a cast metal connecting element utilized in the embodiment shown in FIGS. 2 and 3.
Figure 5:
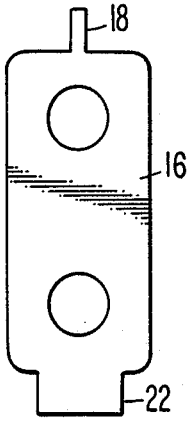
FIG. 5 is an end view of the connecting element shown in FIG. 4.
Figure 6:
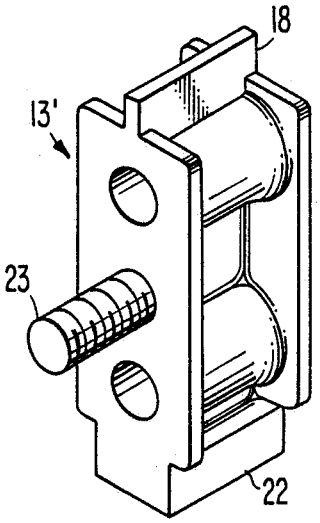
FIG. 6 shows a perspective view of a connecting element provided with a threaded peg or spike.
Figure 7:
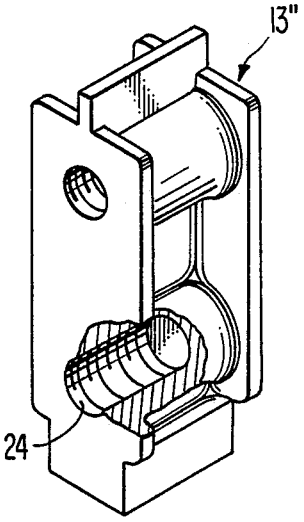
FIG. 7 shows a perspective view, partially in section, of another embodiment of the connecting element provided with a threaded blind bore.

In FIG. 4 the connecting element alone is illustrated. The individual members of the element are integrally formed together during casting or molding of a suitable metal or metal alloy. FIGS. 6 and 7 respectively illustrate embodiments of the connecting element provided with a threaded peg 23 and a threaded blind bore 24.

What is claimed is:

1. An apparatus for the flow-through treatment of textile material, nonwovens, or paper, with a gaseous or liquid treatment medium circulated in the entire apparatus, comprising a permeable drum subjected to throughflow from the outside toward the inside, said drum being under a suction draft and having end plates at end faces and serving as a conveying element, said drum being covered on its periphery with a screen-type cover, sheet metal strips extending in the axial direction of the drum and being arranged between the end plates of the drum, an extension in width of said sheet metal strips extending substantially in the radial direction, and a plurality of connecting elements connecting the sheet metal strips being arranged in the peripheral direction between the sheet metal strips:

(a) said connecting elements each being a one-piece element, (b) said connecting elements each have a width corresponding to a desired spacing of the directly adjacent sheet metal strips, and (c) said connecting elements are firmly connected on both sides with an adjoining sheet metal strip.

2. An apparatus according to claim 1, wherein at least one of the connecting elements is provided at least on one side with a peg-shaped spike pushed through a corresponding opening in the sheet metal strip and being attached to the strip.

3. An apparatus according to claim 2, wherein the spike of the connecting element is provided with threads, and the sheet metal strip is connected to the connecting element by means of a nut threaded onto said threads.

4. An apparatus according to claim 1, wherein at least one of the connecting elements exhibits a blind bore with an internal thread, a screw being threadable into this bore through the sheet metal strip.

5. An apparatus according to claim 1, at least one of the connecting elements is provided over its length (in the peripheral direction of the drum) with a transverse bore, through which a rivet or screw is passed and is connected with the two adjacent sheet metal strips.

6. An apparatus according to claim 5, wherein the rivet or screw connects at least three of the sheet metal strips adjacent to one another in series and thus extends through at least two of the connecting elements.

7. An apparatus according to claim 5, characterized in that each connecting element is fashioned radially inwardly into a wide base, corresponding at least to the width in the range of a tubular portion of the element supporting a rivet or screw.

8. An apparatus according to claim 1, wherein each connecting element extends over a height or extension in width of the sheet metal strip.

9. An apparatus according to claim 8, wherein each connecting element is connected over its height twice with adjacent sheet metal strips by being threaded or riveted thereto.

10. An apparatus according to claim 8, wherein each connecting element is fashioned to be solid over its height and without transverse openings.

11. An apparatus according to claim 8, wherein each connecting element is web-shaped over its length, i.e. is provided in total with a narrow wall which provides strength, and is designed to be wider only in portions at zones of the bores extending therethrough, and radially inwardly at the base.

12. An apparatus according to claim 1, wherein each connecting element is fashioned radially outwardly into a web, which is narrow, preferably at most having the width of the sheet metal thickness of the sheet metal strips.

* * * * *